United States Patent [19]
Seidel et al.
[11] 4,308,541
[45] Dec. 29, 1981

[54] ANTENNA FEED SYSTEM FOR RECEIVING CIRCULAR POLARIZATION AND TRANSMITTING LINEAR POLARIZATION

[76] Inventors: Robert A. Frosch, Administrator of the National Aeronautics and Space Administration, with respect to an invention of Boris L. Seidel, La Canada; Dan A. Bathker, La Crescenta, both of Calif.

[21] Appl. No.: 106,118

[22] Filed: Dec. 21, 1979

[51] Int. Cl.[3] ..... H01Q 21/24
[52] U.S. Cl. ..... 343/786; 343/100 PE; 343/858
[58] Field of Search ..... 343/100 PE, 756, 853, 343/858, 786, 777, 854

[56] References Cited

U.S. PATENT DOCUMENTS

| | | | |
|---|---|---|---|
| 3,086,203 | 4/1963 | Hutchison | 343/786 |
| 3,742,506 | 6/1973 | Wilkinson | 343/854 |
| 3,827,051 | 7/1974 | Foldes | 343/100 PE |
| 4,060,808 | 11/1977 | Foldes | 343/100 PE |

*Primary Examiner*—Eli Lieberman
*Attorney, Agent, or Firm*—Paul F. McCaul; John R. Manning

[57] ABSTRACT

An object is to provide for receiving a circularly polarized signal from an antenna feed (10) connected to orthogonally spaced antenna elements (11, 12, 13, 14) and for transmitting a linearly polarized signal through the same feed without switches, and without suffering a 3 dB polarization mismatch loss, using an arrangement of hybrid junctions. The arrangement is comprised of two dividing hybrid junctions (15, 16), each connected to a different pair of antenna elements and a summing hybrid junction (17). In one embodiment, a receiver (18) is connected to the summing hybrid junction directly. A diplexer (19*a* or 19*b*) is used to connect a transmitter (20*a* or 20*b*) to only one pair of antenna elements. In an alternative embodiment, designated left and right circularly polarized (LCP and RCP) transmitters (21, 22) are connected to the summing hybrid junction by separate diplexers (23, 24), and separate LCP and RCP sensitive receivers (25, 26) are connected to the diplexers in order to transmit linearly polarized signals using all four antenna elements while receiving circularly polarized signals as before. An orthomode junction (30) and horn antenna (32) may replace the two dividing hybrid junctions (15, 16) and antenna feed (10).

8 Claims, 3 Drawing Figures

ANTENNA FEED SYSTEM FOR RECEIVING CIRCULAR POLARIZATION AND TRANSMITTING LINEAR POLARIZATION

ORIGIN OF INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

TECHNICAL FIELD

This invention relates to an antenna feed system which accepts circularly polarized signals while receiving and transmits linearly polarized signals.

BACKGROUND ART

Most of the deep space telecommunications links use circular polarization. One reason for this is because of the operational simplicity of tracking a circularly polarized signal as opposed to a linearly polarized signal. However, linear polarization provides an opportunity to perform scientific investigations and engineering tasks that cannot be done with circular polarization. This being the case, for some space missions it would be desirable to have a downlink from the spacecraft that is linearly polarized. Since the Deep Space Network (DSN) normally radiates a circularly polarized uplink, it has been recognized that a penalty for providing a linear downlink would be 3 dB loss in the uplink due to polarization mismatch. An implementation that provides a linear downlink capability without suffering the 3 dB uplink loss is desirable.

The linearly polarized downlink on the spacecraft would provide an opportunity to conduct investigations, such as of the solar corona with Faraday rotation techniques. In addition, a linearly polarized downlink would provide an opportunity for calibrating the Earth's ionosphere. The calibration of the ionosphere is needed by some deep space missisons to provide precision navigation. Present ionospheric calibration methods are problematic (not line of sight) and use linearly polarized VHF satellites which are becoming less available. Use of a linearly polarized signal in the line-of-sight would be an attractive alternative, that is, use the same downlink for telemetry, ionospheric calibrations, and scientific investigations.

STATEMENT OF INVENTION

An object of this invention is to provide a system for transmitting a linearly polarized signal and for receiving a circularly polarized signal, without suffering a 3 dB polarization mismatch loss.

In its broadest aspects, an antenna capable of receiving a circularly polarized signal is connected to means for separating the signal into orthogonal linear components which are then recombined at the input to the receiver by a summing hybrid junction to present to the receiver the total power carried in the circularly polarized signal received at the antenna. A diplexer is used in at least one linearly polarized component path to permit transmission of a linearly polarized signal through the antenna. In one embodiment, each of two pairs of orthogonally disposed antenna elements are connected to separate ports of separate 180° hybrid junctions, each having a third port connected to the summing hybrid junction for receiving circularly polarized signals at the receiver. Due to the diplexer in the linearly polarized component path to which an active transmitter is connected, only one 180° hybrid is fed while transmitting. Both 180° junctions transfer linearly polarized signals that are orthogonal while receiving a circularly polarized signal. These linearly polarized signals are thus transferred to the summing hybrid junction which extracts all of the power from the circularly polarized signal and couples it to the receiver. Thus, while receiving, the entire energy in the uplink circularly polarized wave at the antenna is coupled to the receiver.

In another embodiment, two transmitters are used, one transmitting a signal with right circular polarization, and the other transmitting a signal with left circular polarization. When both are transmitting simultaneously, the output results in transmission of a linearly polarized signal. If only one transmitter is excited, only right or left circular polarization is transmitted. Two receivers can be connected through diplexers to receive left and/or right circularly polarized signals.

The novel features that are considered characteristic of this invention are set forth with particularity in the appended claims. The invention will best be understood from the following description when read in connection with the accompanying drawings.

DETAILED DESCRIPTION OF THE INVENTION

Figure 1:
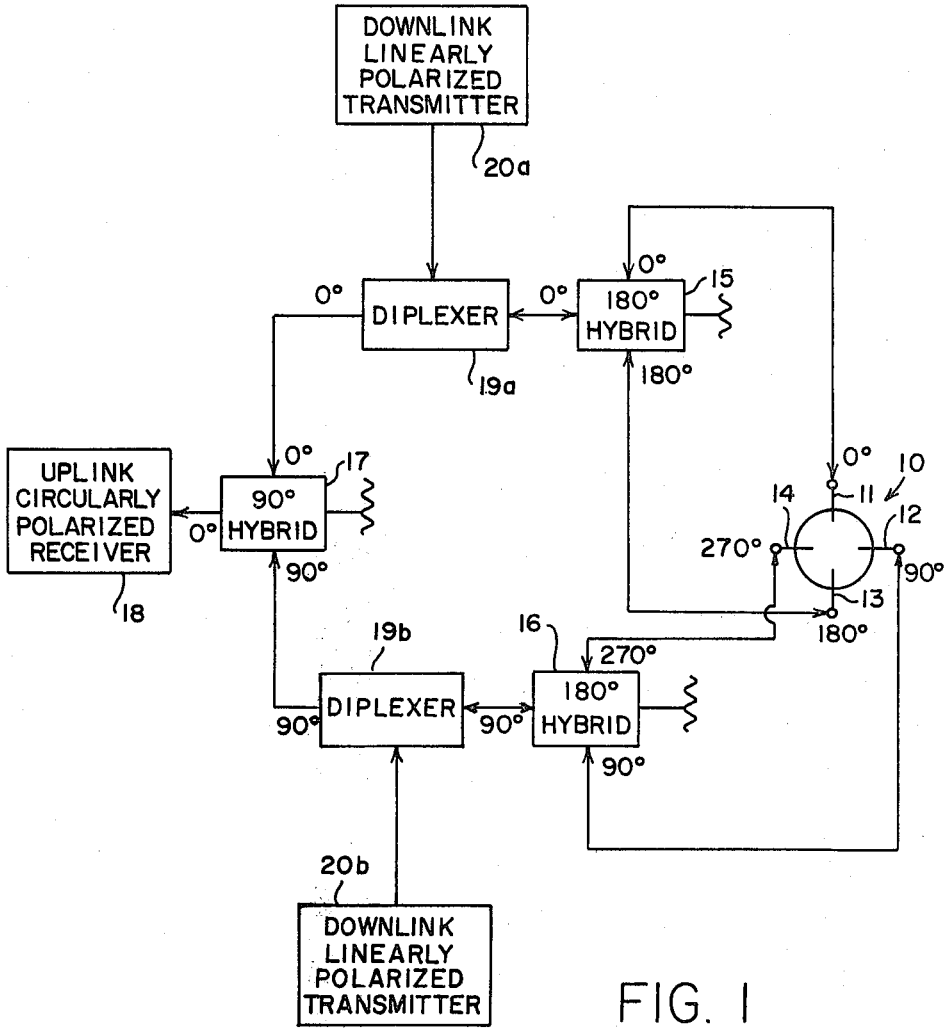
FIG. 1 illustrates one embodiment of the invention.

Before referring to the schematic diagrams of the invention, several useful forms of hybrid junctions will be described, all of which are described in *Radar Handbook* edited by Merrill I. Skolnik and are widely used in microwave systems as power dividing and summing devices. One is the 3 dB directional coupler sometimes called a quadrature hybrid junction or coupler because it divides the power inserted in one port equally between two other ports, with phase quadrature between the two output signals, and provides no power to the fourth port. Another is the magic-T hybrid junction which divides power inserted in one port equally between two other ports, with 0° or 180° phase difference between the two output signals, depending on which input port is used, and provides no power to the fourth port. A third is the hybrid ring which has four ports, 1, 2, 3 and 4, spaced electrically 90° apart, with an electrical spacing of 270° from port 4 to port 1 to complete a ring. A signal into port 1 divides equally with 180° phase difference between port 2 and port 4, and a signal into port 3 divides equally between ports 2 and 4 with zero phase difference.

In the schematic diagrams to be described, the hybrid junctions are represented by rectangles, each having four ports, with an indication of whether it is of the 90° phase difference type, namely a quadrature coupler, or of the 180° phase difference type, namely a magic-T or hybrid ring. In each case, the phase relationships of the ports are indicated, and an unused port is terminated by a suitable impedance to absorb any incidental energy out of that port. However, it should be understood that the invention is not limited to these particular hybrid junctions. The concept of the invention is given to any suitable implementation with due consideration to bandwidth and power handling capabilities.

Referring now to FIG. 1, an antenna feed 10 having orthogonally disposed antenna elements 11, 12, 13 and 14 are grouped in pairs, namely 11, 13 and 12, 14, for coupling through 180° hybrid junctions 15 and 16. The hybrid junctions 15 and 16 are, in turn, coupled by a 90° hybrid junction 17 to a receiver 18 for uplink circularly polarized reception. A diplexer 19*a* connects the hybrid junction 15 to a transmitter 20*a* for downlink linearly polarized signals by excitation of only elements 11 and 13. A diplexer 19*b* connects the hybrid junction 16 to a transmitter 20*b* for downlink transmission of linearly polarized signals by excitation of only elements 12 and 14. Note that the two linearly polarized signals transmitted are orthogonal, so if both are excited simultaneously in phase quadrature, circular polarization could be achieved. However, in practice only one transmitter would be used for transmitting a linearly polarized signal. The other transmitter would serve as a back-up (with its transmission polarized in space orthogonal to the first transmitter).

This arrangement of hybrid junctions provides for a linearly polarized downlink transmission from a spacecraft while allowing the spacecraft to receive a circularly polarized uplink transmission. No switches are required to achieve linear transmit and circular receive operation either individually or simultaneously, and no spacecraft commands are required; the circular receive and transmit capabilities are inherently present for use at all times. All that is necessary besides the hybrid couplers is a diplexer for connecting the transmitter to the hybrid junction 15 (16), and for isolating the hybrid junction 17 connected to the receiver while transmitting.

While receiving, 180° hybrid junctions 15 and 16 feed the summing hybrid junction 17, thereby coupling the circularly polarized uplink transmission to the receiver 18. The diplexer 19*a* automatically couples the hybrid junction 15 to the hybrid junction 17, with essentially no loss to the signal received and essentially no coupling to the transmitter 20*a*. While transmitting, the diplexer 19*a* couples the transmitter 20*a* to the hybrid junction 5 with essentially no loss of the signal transmitted and with essentially no coupling to the summing hybrid junction 17. The transmit power is simply divided once into signals 180° out of phase for excitation of the antenna elements 11 and 13. Operation for the diplexer 19*b* and transmitter 20*b* is similar.

The diplexer 19*a* is essentially a short circuit between hybrid junctions 15 and 17 while receiving, and it is then convenient to view the reciprocal arrangement as transmitting, with the energy source assumed to be occupying the receiver position 18. The hybrid junction 17 divides the assumed energy source into two signals 90° out of phase, and each signal is again divided into two signals 180° out of phase to thereby produce four signals of equal amplitude at the elements of the antenna feed 10 at phase angles of 0°, 90°, 180° and 270°. The signals from one 180° hybrid junction are applied to one pair of diametrically opposite antenna elements, and the signals from the other 180° hybrid junction are connected to the other pair of diametrically opposite antenna elements. The result is a circularly polarized signal. With the receiver back in place, the reciprocal action of receiving the circularly polarized uplink signal results in all of the circularly polarized energy being delivered to the receiver. For transmitting the downlink signal, energy is made available to only one pair of antenna elements for a linearly polarized signal transmission. This arrangement thus provides a solution to the problem of providing a linearly polarized downlink and a circularly polarized uplink, without suffering a 3 dB polarization mismatch loss, and without switches and commands. The arrangement of hybrid junctions and a diplexer enables the polarization change without switches.

Figure 2:
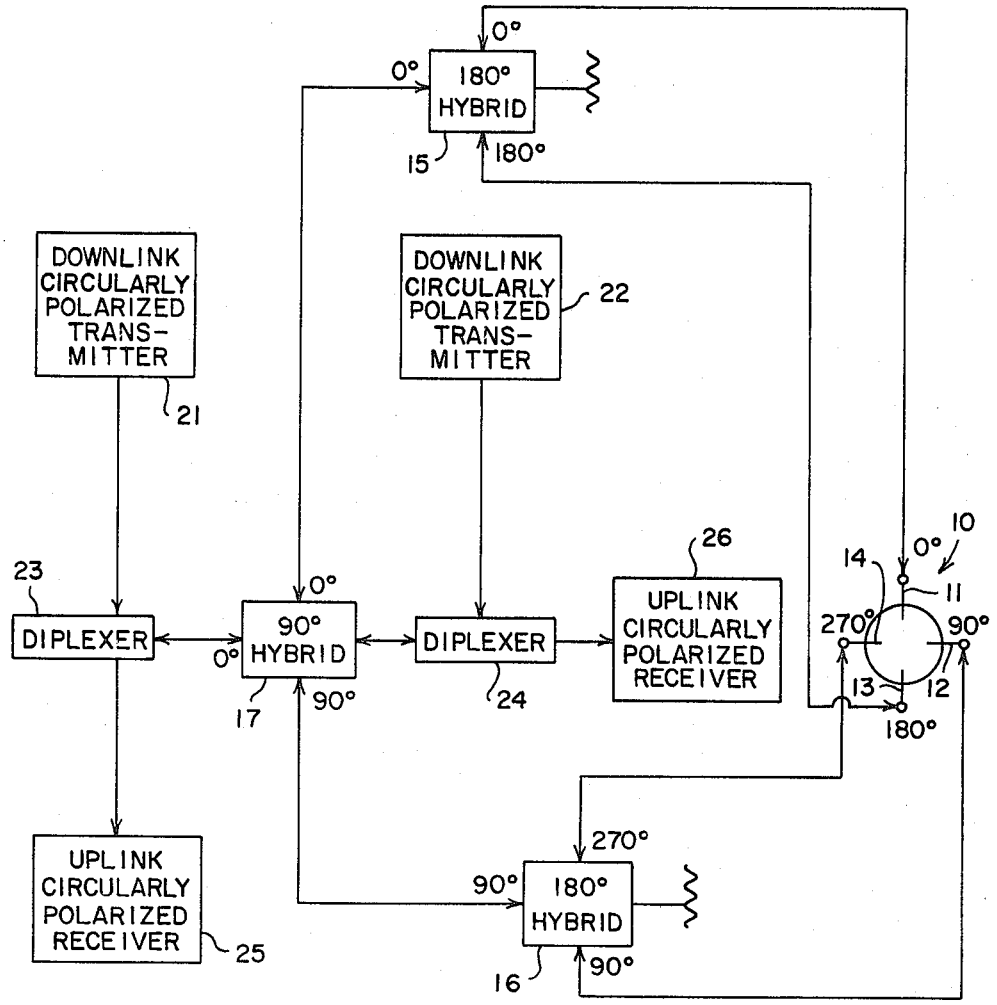
FIG. 2 illustrates an alternative embodiment of the invention.

In the embodiment of FIG. 2, the hybrid junctions 15, 16 and 17 are connected to an antenna feed 10 for a circularly polarized uplink as in the embodiment of FIG. 1, and are therefore identified by the same reference numerals. What is different is that all four antenna elements are exicted for a linearly polarized downlink signal using two transmitters 21 and 22 coupled to the 90° hybrid junction 17 by respective diplexers 23 and 24. A combination of a left circularly polarized (LCP) signal derived from connections associated with transmitter 21 and a right circularly polarized (RCP) signal derived from connections associated with transmitter 22, for example, produces a linear polarization of the downlink signal. If only one transmitter is energized, all antenna elements will still be excited, but then a circularly polarized signal is transmitted, for example, LCP from transmitter 21 or RCP from transmitter 22. While receiving, a receiver 25 coupled to the 90° hybrid junction 17 is sensitive to, for example, RCP energy, and a receiver 26 coupled to the hybrid junction 17 is sensitive to, for example, LCP energy.

Figure 3:
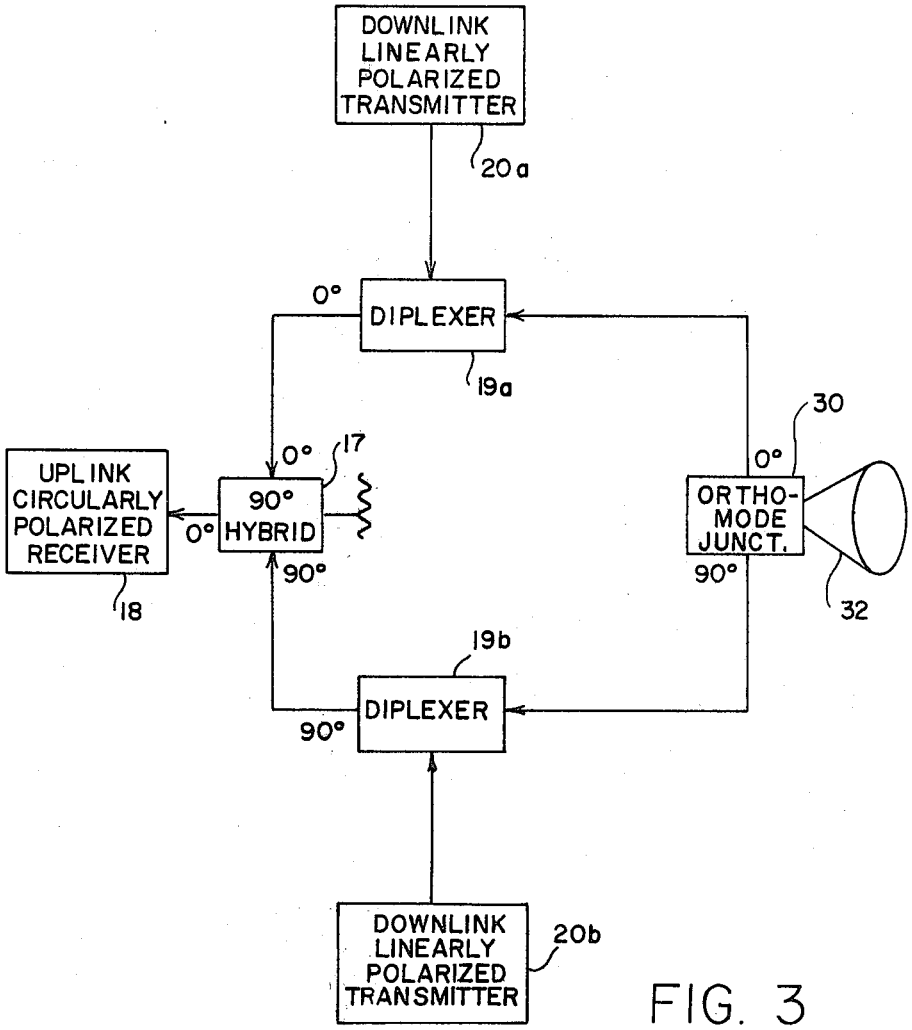
FIG. 3 illustrates still another alternative embodiment.

In a third embodiment shown in FIG. 3, an orthomode junction 30 and a horn antenna 32 effectively replace the 180° hybrid junctions 15 and 16, and the antenna feed 10, respectively, in the arrangements described above with reference to FIG. 1. The output of the orthomode junction while receiving is two orthogonal (0° and 90°) and 90° phase shifted linearly polarized signals which are the components of a circularly polarized uplink signal. The hybrid junction 17 combines the components and presents the total power to the receiver. The diplexer 19*a* is transparent to received signals, and couples the linear transmitter 20*a* to one port of the orthomode junction. The reciprocal action of the orthomode is then one of transmitting through the horn antenna a linearly polarized downlink signal. The diplexer 19*b* and transmitter 20*b* coupled to the other port of the orthomode junction transmit an orthogonal downlink to that of diplexer 19*a* and transmitter 20*a*.

Although particular embodiments of the invention have been described and illustrated herein, it is recognized that modifications and variations may readily occur to those skilled in the art. Consequently, it is intended that the claims be interpreted to cover such modifications and equivalents.

What is claimed is:

1. A system for coupling an antenna feed to means having one port for receiving circularly polarized signals and to means having one port for transmitting linearly polarized signals comprising two transmission paths, means connected to said antenna feed for dividing a received circularly polarized signal into separate linearly and orthogonally polarized signals in said two transmission paths, a quadrature hybrid junction having two input ports, each connected to one of said two transmission paths, and one output port, and having its output port connected to said one port of said receiving means for combining said two linearly and orthogonally polarized signals into a circularly polarized signal, and diplexing means for coupling said one port of said linearly polarized transmitting means into at least one of said two transmission paths for transmitting a linearly polarized signal through said antenna feed.

2. A system as defined in claim 1 wherein said diplexing means is a diplexer in one of said two paths and said linearly polarized transmitting means is a single transmitter connected to said diplexer, whereby circularly polarized signals are received and linearly polarized signals are transmitted through said antenna feed.

3. A system as defined in claim 2 wherein said antenna feed is comprised of at least four antenna elements arranged in two orthogonal pairs and said dividing means is comprised of two 180° hybrid junctions, one for each pair of antenna elements.

4. A system as defined in claim 2 wherein said antenna feed is comprised of a horn antenna and said dividing means is comprised of an orthomode junction.

5. A system as defined in claim 1 wherein said antenna feed is comprised of at least four antenna elements arranged in two pairs of at least two elements and said dividing means is comprised of two hybrid junctions, one for each pair of antenna elements; wherein said means for combining said two linearly polarized signals into a circularly polrized signal in a third path is a hybrid junction having four ports which divides the power inserted in one port equally between two other ports, and provides no power to the fourth port, and divides power inserted in the fourth port equally between said two other ports, and provides no power to said one port; wherein said diplexing means is comprised of two diplexers, one connected to said one port of said hybrid junction and the other connected to said fourth port of said hybrid junction, said diplexers being arranged to be transparent to divided signals received through said antenna feed, whereby circularly polarized signals may be received or transmitted through either diplexer, and linearly polarized signals may be transmitted by simultaneously transmitting through both diplexers.

6. In a two-way signal transmission system for receiving circularly polarized signals at a receiver 18 and transmitting linearly polarized signals from a transmitter, the combination comprising an orthomode antenna means having two ports at which orthogonal linearly polarized signals are provided in response to circularly polarized signals received, a diplexer having three ports, one port coupled to said orthomode antenna means and one port coupled to said transmitter for coupling said transmitter to said orthomode antenna means for transmission of linearly polarized signals, and a third port, and a 90° hybrid junction having a pair of input ports connected respectively to said ports of said antenna means, one of said pair of input ports of said hybrid junction being connected to receive a signal from the third port of said diplexer, said hybrid junction having an output port at which the sum of signals received at said pair of input ports is produced as a circularly polarized signal, said output port being connected to said receiver.

7. The combination of claim 6 in which said antenna means is comprised of antenna elements disposed in two pairs, each pair consisting of at least two opposite antenna elements, and two 180° hybrid junctions, each 180° hybrid junction having two input ports connected to opposite antenna elements of respective pairs of antenna elements and one output port, whereby said two 180° hybrid junctions feed said two pairs of antenna elements.

8. The combination of claim 7 in which said antenna means is comprised of a horn antenna and an orthomode junction coupled to said horn antenna, said orthomode junction having two output ports, whereby said orthomode junction feeds said two ports of said antenna means.

* * * * *